US005605880A

United States Patent [19]

Arai et al.

[11] Patent Number: 5,605,880

[45] Date of Patent: Feb. 25, 1997

[54] LUBRICATING OIL COMPOSITION

[75] Inventors: Katsuya Arai, Iruma-gun; Hirotaka Tomizawa, Tokorozawa, both of Japan

[73] Assignee: Exxon Chemical Patents Inc., Linden, N.J.

[21] Appl. No.: 535,236

[22] PCT Filed: Apr. 28, 1994

[86] PCT No.: PCT/JP94/00723

§ 371 Date: Feb. 9, 1996

§ 102(e) Date: Feb. 9, 1996

[87] PCT Pub. No.: WO94/25549

PCT Pub. Date: Nov. 10, 1994

[30] Foreign Application Priority Data

Apr. 30, 1993 [JP] Japan ..... 5-128049

[51] Int. Cl.[6] ..... C10M 141/06; C10M 141/12

[52] U.S. Cl. ..... 508/379; 508/443; 508/563

[58] Field of Search ..... 508/379, 443, 508/563

[56] References Cited

U.S. PATENT DOCUMENTS

| | | | |
|---|---|---|---|
| 3,505,225 | 4/1970 | Wheeler | 252/33.6 |
| 4,501,678 | 2/1985 | Katayama et al. | 252/32.7 E |
| 4,529,526 | 7/1985 | Inoue et al. | 252/32.7 E |
| 4,704,216 | 11/1987 | Hata et al. | 252/32.7 E |
| 4,812,246 | 3/1989 | Yabe | 252/32.7 E |
| 5,445,749 | 8/1995 | Hong | 252/33.6 |

*Primary Examiner*—Jacqueline V. Howard
*Attorney, Agent, or Firm*—Estelle C. Bakun

[57] ABSTRACT

A lubricating oil composition is provided which is obtained by containing in (A) a base oil in which the content of the aromatic ingredients is 3.0% by weight or less, N is 50 ppm by weight or less, S is 50 ppm by weight, and the viscosity is 2.0–50.0 $mm^2/s$, based on the total weight of the composition, (B) 0.05–2.0% by weight of alkyldiphenylamine(s) and/or phenyl-α-naphthylamine(s) and (C) MoDTC of $C_{8-23}$ and/or $C_{3-18}$ in an amount of 50–2,000 ppm by weight in terms of the amount of molybdenum. Such a lubricating oil composition has high heat-resistant properties, a high stability to oxidation, and improved friction characteristics, and is suitably used especially as a lubricating oil for internal combustion engines.

1 Claim, No Drawings

LUBRICATING OIL COMPOSITION

FIELD OF THE INVENTION

The present invention relates to a novel lubricating oil composition, more specifically, a lubricating oil composition having a high heat performance, a high stability to oxidation, and low friction characteristics. The lubricating oil composition is suitable as a lubricating oil for internal combustion engines, automatic speed regulators, shock absorbers, power steering, etc., and is especially suitable as a lubricating oil for internal combustion engines.

BACKGROUND OF THE INVENTION

Conventionally, for internal combustion engines, a lubricating oil is used to smooth the operation of driving apparatus such as automatic speed regulators, shock absorbers, power steering, and gears. Especially, lubricating oils for internal combustion engines (engine oils), besides lubricating various engine parts such as valve gear mechanisms, including mainly piston rings, cylinder liners, bearings of crank shafts and connecting rods, cams, and valve lifters, also act to cool engines, clean and disperse combustion products, and prevent rust and corrosion.

As stated above, various performances are required for lubricating oils for internal combustion engines. Also, recently, under circumstances wherein there are high performances and power outputs in internal combustion engines and wherein they are under severe operating conditions, high performances have been required. Thus to satisfy such required performances, various additives such as a wear-preventive agent, a metal detergent, an ash-free detergent dispersant, an anti-oxidant, etc., are compounded in the lubricating oils for internal combustion engines.

For the fundamental performances of lubricating oils for internal combustion engines it is especially important to make engines act smoothly under various conditions and to prevent wear and seizing. The parts of engines that are lubricated are almost in a fluid-lubricating state. However, the top and bottom dead centers of valve gear systems and pistons tend to be in a boundary lubrication state. The wear-prevention properties under such a boundary lubrication state are typically imparted by adding zinc dithiophosphate (ZnDTP) or zinc dithiocarbamate (ZnDTC).

Since in an internal combustion engine the loss of energy from frictional parts, on which a lubricating oil acts, is high, for measures to decrease friction loss and fuel consumption loss lubricating oils are used in which a friction modifier and various additives are added (for example, see Japanese Patent Publication No. 3-23595). Lubricating oils for automotive internal combustion engines are used under various conditions, such as various oil temperatures, number of revolutions, and loads. Thus to further improve fuel consumption loss they are required to be excellent in friction characteristics under a wide range of used conditions.

Also, for performances that are required in lubricating oils for internal combustion engines, besides those stated above, high heat-resistant properties, a high stability to oxidation, and proper viscosity properties, are exemplified.

SUMMARY OF THE INVENTION

1. Disclosure of the Invention

Under these circumstances the object of the present invention resides in providing a lubricating oil composition having, besides low friction characteristics, high heat-resistant properties, a high stability to oxidation, and proper viscosity properties, and that is especially suitable for lubricating oils for internal combustion engines.

2. Means to Resolve the Problems

As a result of the extensive study by the inventors of the present invention to develop a lubricating oil composition having the above preferred properties, they have found that the above object is attained with a composition obtained by containing, in a lubricating base oil having a low content of aromatic ingredients and specified properties, a specified amine-type anti-oxidative agent, oxymolybdenum sulfide dithiocarbamate (MoDTC), or oxymolybdenum sulfide organophosphorodithioate (MoDTP), in a given ratio. Based on this finding they accomplished the present invention.

That is, the present invention relates to a lubricating oil composition characterized by containing in (A) a lubricating base oil in which the content of the aromatic ingredients is 3.0% by weight or less, the sulfur content is 50 ppm by weight or less, the nitrogen content is 50 ppm by weight or less, and the viscosity at 100° C. is 2.0–50.0m$^2$/s, based on the total weight of the composition, (B) 0.05–2.0% by weight of at least one kind of compound selected from the group consisting of alkyl diphenylamines represented by the general formula:

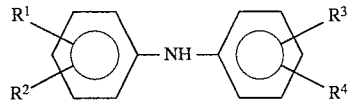

(1)

wherein $R^1$, $R^2$, $R^3$, and $R^4$, which may be the same or different, are each a hydrogen atom or an alkyl group having 3–18 carbon atoms, provided that at least one of them is said alkyl group, and phenyl-α-naphthyl amines represented by the general formula:

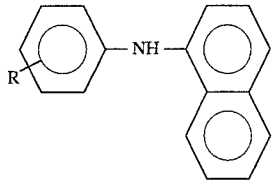

(2)

wherein R is a hydrogen atom or an alkyl group having 3–18 carbon a toms, and (C) 50–2,000 ppm by weight in terms of the amount of molybdenum of at least one kind of compound selected from the group consisting of oxymolybdenum sulfide dithiocarbamates represented by the general formula:

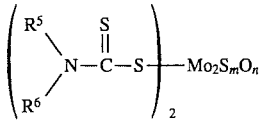

(3)

wherein $R^5$ and $R^6$, which may be the same or different, are each a hydrocarbon group having 8–23 carbon atoms, "m" and "n" are each a positive integer such that their sum is 4, and oxymolybdenum sulfide organophosphorodithioates represented by the general formula:

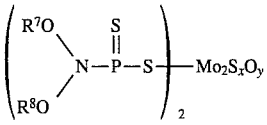

(4)

wherein $R^7$ and $R^8$, which may be the same or different, are each a hydrocarbon group having 3–18 carbon atoms, and "x" and "y" are each a positive integer such that their sum is 4.

3. Effects of the Invention

The lubricating oil compositions of the present invention have high heat-resistant properties, a high stability to oxidation, and low friction characteristics, and are suitably used as a lubricating oil for internal combustion engines, automatic speed regulators, shock absorbers, and power steering, and especially as a lubricating oil for internal combustion engines.

BRIEF EXPLANATION OF DRAWING

FIG. 1 is a schematic drawing of a device used in a LFW-1 Friction Test. In FIG. 1, 1 is an S-test ring, 2 is an R-type block, and 3 is a strain meter.

DETAILED EXPLANATION OF THE EMBODIMENT

Below the present invention will be explained in detail.

In the lubricating oil compositions of the present invention, as the lubricating base oil of ingredient (A), an oil is used in which the content of the aromatic ingredients is 3.0% by weight or less, the sulfur content is 50 ppm by weight or less, the nitrogen content is 50 ppm by weight or less, and the viscosity at 100° C. is 2.0–50.0 $mm^2/s$. If the content of the aromatic ingredients in the composition exceeds 3.0% by weight, the heat-resistant properties, oxidation stability, and friction characteristics, decrease. If the viscosity is less than 2.0 $mm^2/s$, the formation of film is insufficient and a greatly inconvenient evaporation loss occurs. If the viscosity exceeds 50.0 $mm^2/s$, the loss of mechanical power caused by the viscosity resistance is too much and thus is undesirable. If either the sulfur content or nitrogen content exceeds 50 ppm by weight, the oxidation stability and friction characteristics decrease.

As the lubricating base oil, without distinguishing between them, various mineral oils or synthetic oils can be used if they have the above properties. Hydrogenized oils and wax-isomerized oils are especially suitable.

As the amine-type anti-oxidant of ingredient (B) of the composition of the present invention, at least one kind of compound is used that is selected from the group consisting of alkyl diphenylamines represented by the general formula:

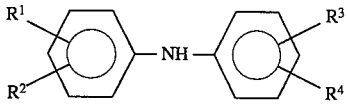

(1)

and phenyl-α-naphthyl amines represented by the general formula:

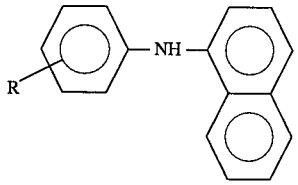

(2)

In general formula (1), $R^1$, $R^2$, $R^3$, and $R^4$ are each a hydrogen atom or an alkyl group having 3–18 carbon atoms. Although they may be the same or different, at least one of them should be an alkyl group having 3–18 carbon atoms. The alkyl group having 3–18 carbon atoms may be linear, branched, or cyclic. Such an alkyl group may be any propyl group, any butyl group, any amyl group, any hexyl group, any heptyl group, any octyl group, any nonyl group, any decyl group, any undecyl group, any dodecyl group, any tridecyl group, any tetradecyl group, any pentadecyl group, any hexadecyl group, any heptadecyl group, any octadecyl group, a cyclohexyl group, a cyclooctyl group, and a cyclododecyl group.

In general formula (2), R is a hydrogen atom or an alkyl group having 3–18 carbon atoms. The alkyl group having 3–18 carbon atoms may be linear, branched, or cyclic. As such an alkyl group, the same groups as exemplified for $R^1$ to $R^4$ are exemplified.

In the composition of the present invention, as the amine-type anti-oxidant of ingredient (B), one kind of alkyldiphenylamine represented by general formula (1) may be used alone or two or more kinds of the alkyldiphenylamine may be used together. Also, one kind of phenyl-α-naphthylamine represented by aeneral formula (2) may be used alone or two or more kinds of the phenyl-α-naphthylamine may be used together. Also, one or more kinds of alkyldiphenylamine represented by general formula (1) and one or more kinds of phenyl-α-naphthylamine represented by general formula (2) may be used together.

In the composition of the present invention the amine-type antioxidant of ingredient (B) needs to be compounded based on the total weight of the composition in an amount of 0.05–2.0% by weight, preferably 0.2–1.2% by weight. If the amount of the amine-type antioxidant is less than 0.05% by weight a sufficient stability to oxidation cannot be attained, and if the amount exceeds 2.0% by weight an improved stability is not found for the amount.

In the composition of the present invention, as the friction modifier of ingredient (C), at least one kind of compound is used which is selected from the group consisting of oxymolybdenum sulfide dithiocarbamates (MoDTC) represented by general formula (3):

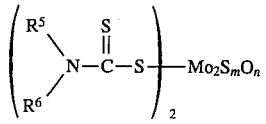

(3)

and oxymolybdenum sulfide organophophorodithioates (MoDTP) represented by general formula (4):

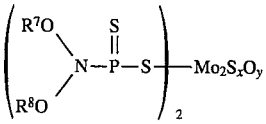

(4)

In general formula (3), $R^5$ and $R^6$, which may be the same or different, are each a hydrocarbon group having 8–23 carbon atoms. As the hydrocarbon group having 8–23 carbon atoms, linear or branched alkyl and alkenyl groups having 8–23 carbon atoms, and cycloalkyl, aryl, alkylaryl, and arylalkyl groups having 8–23 carbon atoms, are exemplified. As such a hydrocarbon group, a 2-ethylhexyl group, a n-octyl group, a nonyl group, a decyl group, a lauryl group, a tridecyl group, a palmityl group, a stearyl group, an oleyl group, an eicosyl group, a butyl phenyl group, and a nonyl phenyl group, are specifically exemplified. "m" and "n" are each a positive integer such that their sum is 4.

In general formula (4), $R^7$ and $R^8$, which may be the same or different, are each a hydrocarbon group having 3–18 carbon atoms.

As the hydrocarbon group having 3–18 carbon atoms, linear or branched alkyl and alkenyl groups having 3–18 carbon atoms, and cycloalkyl groups having 6–18 carbon atoms, aryl groups having 6–18 carbon atoms, and alkylaryl and arylalkyl groups having 7–18 carbon atoms, are exemplified. As such a hydrocarbon group, an isopropyl group, a n-propyl group, a n-butyl group, an isobutyl group, a sec-butyl group, an amyl group, a hexyl group, a cyclohexyl group, a 2-ethylhexyl group, a n-octyl group, a nonyl group, a decyl group, a lauryl group, a tridecyl group, a palmityl group, a stearyl group, an oleyl group, a butyl phenyl group, a nonyl phenyl group, etc., are specifically exemplified. "x" and "y" are each a positive integer such that their sum is 4.

In the composition of the present invention one kind of MoDTC represented by general formula (3) may be used alone, or two or more kinds of the MoDTC may be used together. Also, one kind of MoDTP represented by general formula (4) may be used alone, or two or more kinds of the MoDTP may be used together.

In the composition of the present invention the friction modifier of ingredient (C) needs to be compounded based on the total weight of the composition in an amount of 50–2,000 ppm by weight in terms of the amount of molybdenum, preferably 100–1,000 ppm by weight. If the amount of the molybdenum of the friction modifier is less than 50 ppm by weight, sufficient low-friction characteristics cannot be attained, and if the amount exceeds 2,000 ppm by weight an improved effect in friction characteristics for the amount cannot be obtained.

To the lubricating oil composition of the present invention various additives conventionally used in lubricating oils, such as a metal detergent, an ash-free detergent dispersant, a wear-preventing agent, a viscosity index-improving agent, a pour-point lowering agent, a rust-preventive agent, a corrosion inhibitor, a defoaming agent, and other anti-oxidants, may be optionally added in a ratio such that the object of the invention will be attained without fail.

As the metal detergent, calcium sulfonate, magnesium sulfonate, barium sulfonate, calcium phenate, barium phenate, etc., are exemplified. They are usually used in a ratio of 0.1–5 % by weight.

As the ash-free detergent dispersant, succinic imide-type compounds, succinic amide-type compounds, benzyl amine-type compounds and boron derivatives thereof, and ester-type compounds, are exemplified. They are usually used in a ratio of 0.5–7% by weight.

As the wear-preventive agent, metal salts of thiophosphoric acid (the metal may be Zn, Pb, Sb, Mo, etc.), metal salts of thiocarbamic acid (the metal may be Zn etc.), sulfur compounds, phosphoric esters, and esters of phophorous acid, are exemplified. They are usually used in a ratio of 0.05–5.0% by weight.

As the viscosity-index improving agent, polymethacrylate-type compounds, polyisobutylene-type compounds, ethylene-propylene copolymer-type compounds, and hydrogenated styrene-butadiene copolymer-type compounds, are exemplified. They are usually used in a ratio of 0.5–35% by weight.

As the rust-preventive agent, alkenyl succinic acids and partly estertried alkenyl succinic acids may be used. As the corrosion-inhibitor, benzotriazole and benzoimidazole may be used. As the defoaming agent, dimethyl polysiloxane and polyacrylate may be used. They may be optionally added.

EXAMPLE

The present invention is illustrated in detail by the following Examples, but is not limited to them.

(1) Oxidation-inducing Time (minutes)

The oxidation-inducing time was determined by differential thermal analysis in an oxygen atmosphere, at 20 kg f/cm$^2$, under an isothermal maintenance condition of 200° C.

(2) Coefficient of Friction (μ)

The LFW-1 friction test was conducted by a LFW-1 testing device shown in FIG. 1 using an R-type block (made of iron) produced by Falex Co., and an S-10 test ring (made of iron) also produced by Falex Co., at a number of revolutions of 270 rpm, under a load of 30 kg f, at an oil temperature of 120° C., for 10 minutes. In FIG. 1, 1 designates an S-10 test ring, 2 an R-type block, and 3 a strain meter. The load is applied on an R-type block, and the resistance generated when the ring is revolved is determined by the strain meter, and the coefficient of friction is then calculated. About one-half of the ring is immersed in a test oil.

EXAMPLES 1–7, COMPARATIVE EXAMPLES 1–6

Lubricating oil compositions having a composition shown in Tables 2-1 and 2-2 were prepared by using a base oil having the properties shown in Table 1. The oxidization-inducing times (min.) and the coefficients of friction (g) were. determined. The results are shown in Tables 2-1 and 2-2.

TABLE 1

| Base Oil | Viscosity, 100° C. (mm$^2$/s) | Aromatic Content (wt %) | Sulfur Content (ppm by weight) | Nitrogen Content (ppm by weight) |
|---|---|---|---|---|
| 70N | 3.1 | 1.1 | 1.0 | 0.3 |
| 150N-1 | 5.5 | 0.5 | 0.5 | 0.1 |
| 350N | 9 | 1.3 | 0.7 | 0.1 |
| 150N-2 | 5.6 | 7.0 | 13.0 | 7.0 |
| 150N-3 | 5.4 | 2.0 | 137.0 | 71.0 |
| 150N-4 | 5.7 | 4.1 | 11.0 | 89.0 |

TABLE 2-1

| | | | Example 1 | Example 2 | Example 3 | Example 4 | Example 5 | Example 6 | Example 7 |
|---|---|---|---|---|---|---|---|---|---|
| Ingredient Composition (% by weight) | Base Oil | 70N | Balance | — | — | — | — | — | — |
| | | 150N-1 | — | Balance | — | Balance | Balance | Balance | Balance |
| | | 350N | — | — | Balance | — | — | — | — |
| | | 150N-2 | — | — | — | — | — | — | — |
| | | 150N-3 | — | — | — | — | — | — | — |
| | | 150N-4 | — | — | — | — | — | — | — |
| | Alkyl ($C_{4-8}$) diphenylamine | | 0.5 | 0.5 | 0.5 | 1.5 | — | — | 0.5 |
| | Alkylated ($C_8$) phenyl-α-naphthylamine | | — | — | — | — | 0.3 | 1.2 | — |
| | 4,4'-methylene-bis (2,6-di-tert-butylphenol) | | — | — | — | — | — | — | — |
| | MoDTC($C_{13}$) | | 1.0 | 1.0 | 1.0 | 1.0 | 1.0 | 1.0 | — |
| | MoDTP($C_6$) | | — | — | — | — | — | — | 0.6 |

TABLE 2-1-continued

| | | Example 1 | Example 2 | Example 3 | Example 4 | Example 5 | Example 6 | Example 7 |
|---|---|---|---|---|---|---|---|---|
| Evaluation | Coefficient of Friction (μ) | 0.035 | 0.039 | 0.042 | 0.041 | 0.040 | 0.037 | 0.045 |
| | Oxidation-inducing Time (min) | 24.3 | 25.6 | 29.3 | 33.6 | 26.6 | 36.1 | 25.9 |

TABLE 2-2

| | | | Comparative Example 1 | Comparative Example 2 | Comparative Example 3 | Comparative Example 4 | Comparative Example 5 | Comparative Example 6 |
|---|---|---|---|---|---|---|---|---|
| Ingredient Composition (% by weight) | Base Oil | 70N | Balance | — | — | — | — | — |
| | | 150N-1 | — | — | — | — | — | — |
| | | 350N | — | — | — | — | Balance | — |
| | | 150N-2 | Balance | — | — | Balance | — | — |
| | | 150N-3 | — | Balance | — | — | — | — |
| | | 150N-4 | — | — | Balance | — | — | Balance |
| | Alkyl ($C_{4-8}$) diphenylamine | | 0.5 | 0.5 | — | 0.5 | — | — |
| | Alkylated ($C_8$) phenyl-α-naphthylamine | | — | — | 1.2 | — | — | — |
| | 4,4'-methylene-bis (2,6-di-tert-butylphenol) | | — | — | — | — | 0.5 | 0.5 |
| | MoDTC($C_{13}$) | | 1.0 | 1.0 | 1.0 | — | 1.0 | 1.0 |
| | MoDTP($C_6$) | | — | — | — | 0.6 | — | — |
| Evaluation | Coefficient of Friction (μ) | | 0.035 | 0.049 | 0.051 | 0.053 | 0.050 | 0.056 |
| | Oxidation-inducing Time (min) | | 15.2 | 14.3 | 21.8 | 13.9 | 21.3 | 16.4 |

We claim:

1. A lubricating oil composition characterized by containing, in (A) a lubricating base oil in which the content of the aromatic ingredients is 3.0% by weight or less, the sulfur content is 50 ppm by weight or less, the nitrogen content is 50 ppm by weight or less, and the viscosity at 100% is 2.0–50.0 $mm^2$, based on the total weight of the composition, (B) 0.05–2.0% by weight of at least one kind of compound selected from the group consisting of alkyldiphenylamines represented by the general formula:

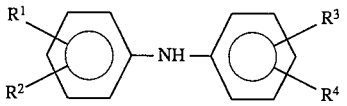

(1)

wherein $R^1$, $R^2$, $R^3$, and $R^4$, which may be the same or different, are each a hydrogen atom or an alkyl group having 3–18 carbon atoms, provided that at least one of them is said alkyl group, and phenyl-α-naphthyl amines represented by the general formula:

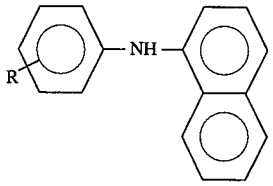

(2)

wherein R is a hydrogen atom or an alkyl group having 3–18 carbon atoms, and (C) 50–2,000 ppm by weight in terms of the amount of molybdenum of at least one kind of compound selected from the group consisting of oxymolybdenum sulfide dithiocarbamates represented by the general formula:

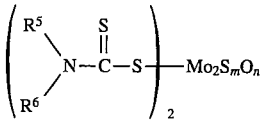

(3)

wherein $R^5$ and $R^6$, which may be the same or different, are each a hydrocarbon group having 8–23 carbon atoms, "m" and "n" are each a positive integer such that their sum is 4, and oxymolybdenum sulfide organophosphorodithioates represented by the general formula:

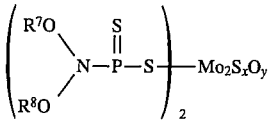

(4)

wherein $R^7$ and $R^8$, which may be the same or different, are each a hydrocarbon group having 3–18 carbon atoms, and "x" and "y" are each a positive integer such that their sum is 4.

* * * * *

UNITED STATES PATENT AND TRADEMARK OFFICE

CERTIFICATE OF CORRECTION

PATENT NO. : 5,605,880

DATED : February 25, 1997

INVENTOR(S) : Katsuya Arai, et al

It is certified that error appears in the above-indentified patent and that said Letters Patent is hereby corrected as shown below:

In claim 1, column 7, line 38, delete "100%" and insert --100°C--.

Signed and Sealed this

Sixteenth Day of September, 1997

*Attest:*

Bruce Lehman

BRUCE LEHMAN

*Attesting Officer*

*Commissioner of Patents and Trademarks*